US005108225A

United States Patent [19]

Neal

[11] Patent Number: 5,108,225

[45] Date of Patent: Apr. 28, 1992

[54] ELEVATED WALL RESERVOIR SYSTEM

[76] Inventor: Charles W. Neal, 1630 Lily Ave., El Cajon, Calif. 92021

[21] Appl. No.: 770,125

[22] Filed: Oct. 2, 1991

[51] Int. Cl.[5] ..... B65G 5/00

[52] U.S. Cl. ..... 405/53; 405/52; 405/114

[58] Field of Search ..... 405/52, 53, 55, 107, 405/114, 116, 210; 52/169.7

[56] References Cited

U.S. PATENT DOCUMENTS

| | | | |
|---|---|---|---|
| 3,504,496 | 4/1970 | Hnot | 405/53 |
| 3,592,009 | 7/1971 | Alkmaar et al. | 405/53 |
| 3,782,124 | 1/1974 | Pladys | 405/53 |
| 3,922,823 | 12/1975 | King et al. | 405/53 X |
| 3,943,721 | 3/1976 | Azalbert et al. | 405/55 |
| 5,061,118 | 10/1991 | Lemperiere | 405/114 X |

*Primary Examiner*—David H. Corbin

*Attorney, Agent, or Firm*—Charles C. Logan, II.

[57] ABSTRACT

An elevated wall reservoir system that has a floating cover assembly that lies directly on the top surface of the body of liquid. The peripheral edges of the cover assembly extend beyond the edge of the liquid and are resiliently secured by tension cables that are attached to tension towers. The tension cables hold the cover assembly in position on the top surface of the liquid and permit the cover assembly to travel upwardly or downwardly in response to the liquid level. Thus the cover assembly is always supported by the liquid and tension in the tension cables. The elevated wall reservoir system allows existing reservoirs to be modified to increase their storage volume by twenty or fourty percent without the need of utilizing additional land area. The elevated wall reservoir system can also be used on new installations.

10 Claims, 3 Drawing Sheets

ELEVATED WALL RESERVOIR SYSTEM

BACKGROUND OF THE INVENTION

The invention relates to large liquid containers and more particularly to reservoirs having a cover assembly.

Throughout the world the necessity for a wholesome water supply is essential to sustain the life and health of mankind. Many areas of the world have population concentrations where local water resources cannot support the demands placed on the limited water supply. Through the ingenuity of engineers, construction of very complex water transport and storage systems have been sucessfully implemented to make remote water resources accessible to population centers hundreds of miles away from the waters source. Increased demands for the limited water resources continue to challange engineers for unique solutions to enhance water supplies. Drought weather patterns aggravate the situation where preserving and utilizing the precious water resources have become of paramount importance to the government and the populus at large.

In order to conserve water resources, many reservoirs are having floating cover assemblies installed to cut down on evaporation and also contamination of the water in the reservoir. The existing water reservoirs have been costly to build and in most cases it would be very costly to modify them in order to allow them to store more water. Also, many reservoirs cannot be expanded laterally due to the nature of the land configuration they were built on.

It is an object of the invention to provide a novel elevated wall reservoir system that can be installed on existing reservoirs whereby the storage volume of the existing reservoir can be increased 20 to 40%.

It is also an object of the invention to provide a novel elevated wall reservoir system that allows the storage volume of an existing reservoir to be increased without requiring a lateral expansion of the structure of the reservoir.

It is another object of the invention to provide a novel elevated wall reservoir system that incorporates the structure of existing floating cover assemblies on top of the water that are designed to maintain contact with the top surface of the water whether in its high or low condition.

It is a further object of the invention to provide a novel elevated wall reservoir system that comparatively speaking is a relatively economical way to increase the storage volume of an existing reservoir by 20 to 40%.

It is an additional object of the invention to provide a novel elevated wall reservoir system that can be utilized with reservoirs having various peripheral contours.

SUMMARY OF THE INVENTION

With the current intense emphasis on conserving, storing and protecting water supplies, a very unique water storage structure has been developed which accomplishes these objectives. The elevated wall reservoir (EWR) system when implemented will conserve, increase storage, and protect the precious water supply. The novel structure incorporates two complex primary elements into the storage system. These two primary elements consist of an elevated free standing reinforced concrete perimeter wall and a mechanical tension system which incorporates an impermeable reservoir liner system.

The EWR system allows for installation of any size, shape, and configuration whereas conventional storage methods have been typically limited to strip applications. The EWR system allows for complete flexibility in that it may be installed in conjunction with a completely new storage facility or it may be added to an existing storage facility. In either case, a 20 to 40% increase in storage volume can be realized by installing the EWR system on a given reservoir site without the need of utilizing additional land area. Generally, the EWR system would be well suited for applications in conjunction with earthen embankment type reservoir construction applications. Where a water system operator has a need to expand storage requirements it will be possible to save a substantial sum of money by installing the EWR system on an existing storage facility to accomplish the desired storage capacity.

Given that the EWR system is not constrained by shape or configuration of the reservoir geometry, a reinforced concrete wall which provides for structural integrity of the complete system can be designed to sustain any individual or combined loading conditions typically experienced in reservoir storage facilities. The reinforced concrete reservoir wall does not require the development of hoop stress to withstand internal or external loads, thus allowing for the wall to be constructed in a straight line. Typical loading conditions can be calculated for the EWR system and it can be designed to withstand seismic waves and weather conditions such as gale force winds and freezing.

DESCRIPTION OF THE PREFERRED EMBODIMENT

Figure 1:
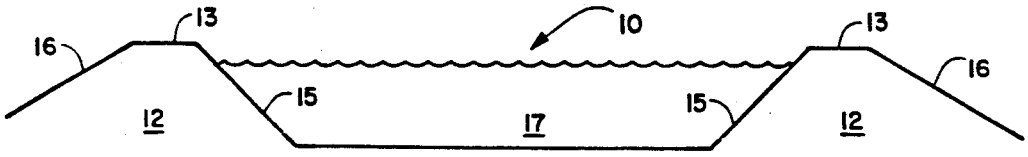
FIG. 1 is a schematic side elevation view of a conventional earthen wall reservoir.

The schematic view of an existing conventional and state of the art reservoir is illustrated in FIG. 1. Reservoir 10 has a periphery defined by inner faces of a surrounding containing wall 12, commonly called a berm, the berm having a generally horizontal upper surface 13 serving as a walkway. Slopping inner and outer surfaces 15 and 16 extend downwardly from the walkway at angles shown.

The inventor's novel elevated wall reservoir system is illustrated in FIGS. 2-5 and it is generally designated numeral 20. The EWR system can be easily installed on existing structure such as that illustrated in FIG. 1. A combination footing and elevated wall assembly 22 would be installed in the horizontal ground surface 13. It would form a closed loop conforming to the configuration of the existing reservoir.

Combination footing and elevated wall assembly 22 has a footing portion 24 and a vertical top wall portion 26. Footing portion 24 has a horizontal base member 28 having a width W. Extending downwardly from its bottom surface is a vertical leg portion 30 having a length D. Vertical top wall portion 26 has a height H. The combination footing and elevated wall assembly 22 would have rebar running through its interior structure in a predetermined pattern that has been approved by local codes and a licensed engineer. The vertical top wall portion 26 would be preferrably formed as a single length of vertical wall and would be sealed to horizontal base member 28 with a PVC waterstop 32 connected between them and a sealant groove 33 would be formed along its inner surface. The lengths of vertical wall would interfit with each other in the manner illustrated in FIG. 5. A PVC water stop 36 would interconnect adjacent vertical wall members and they would have a sealant groove 37 between them.

Figure 2:
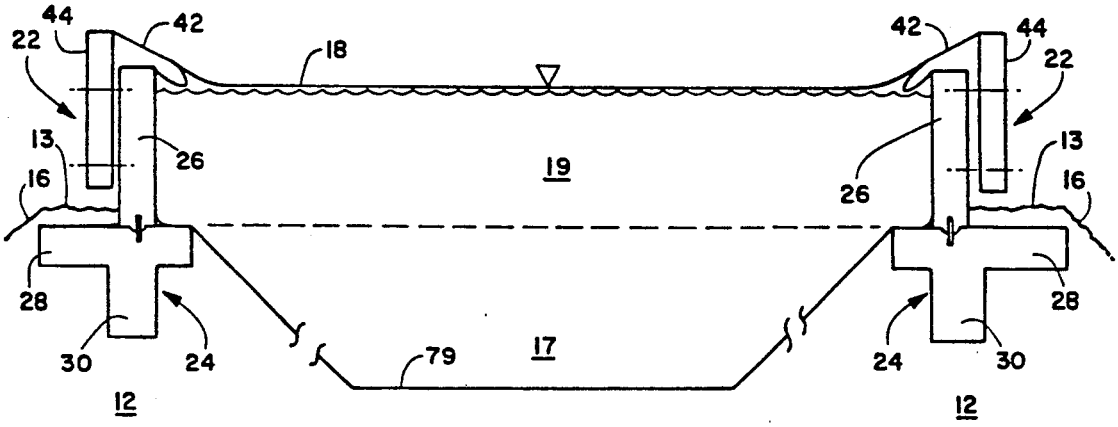
FIG. 2 is a schematic side elevation view of the inventor's novel elevated wall reservoir system.
Figure 3:
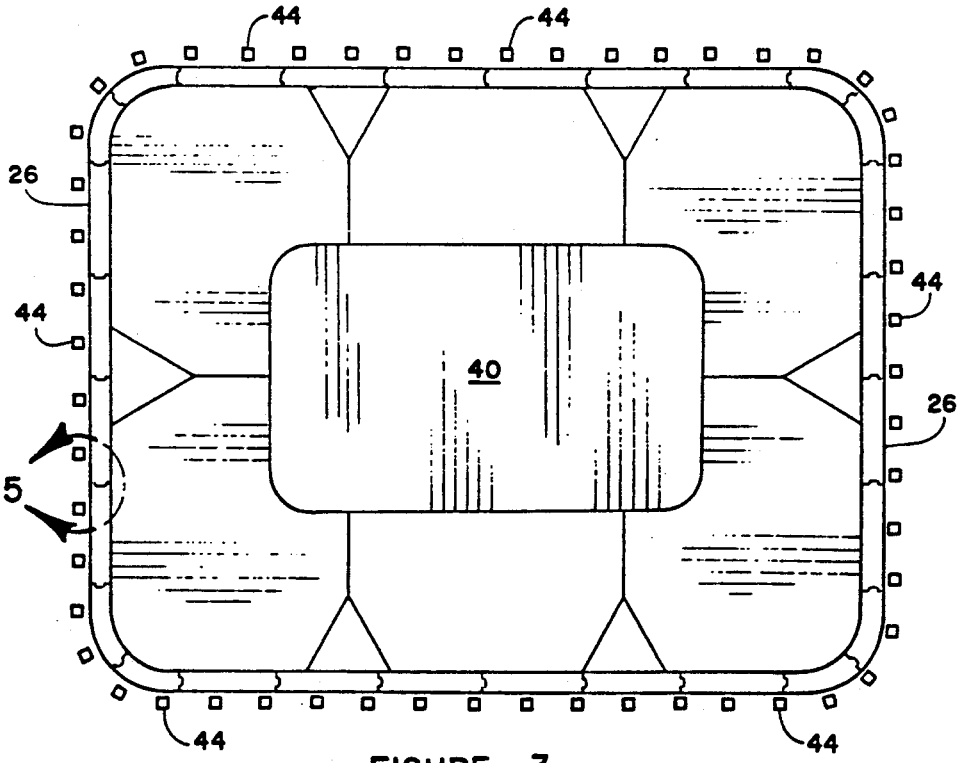
FIG. 3 is a top plan view of the reservoir illustrated in FIG. 2.
Figure 4:
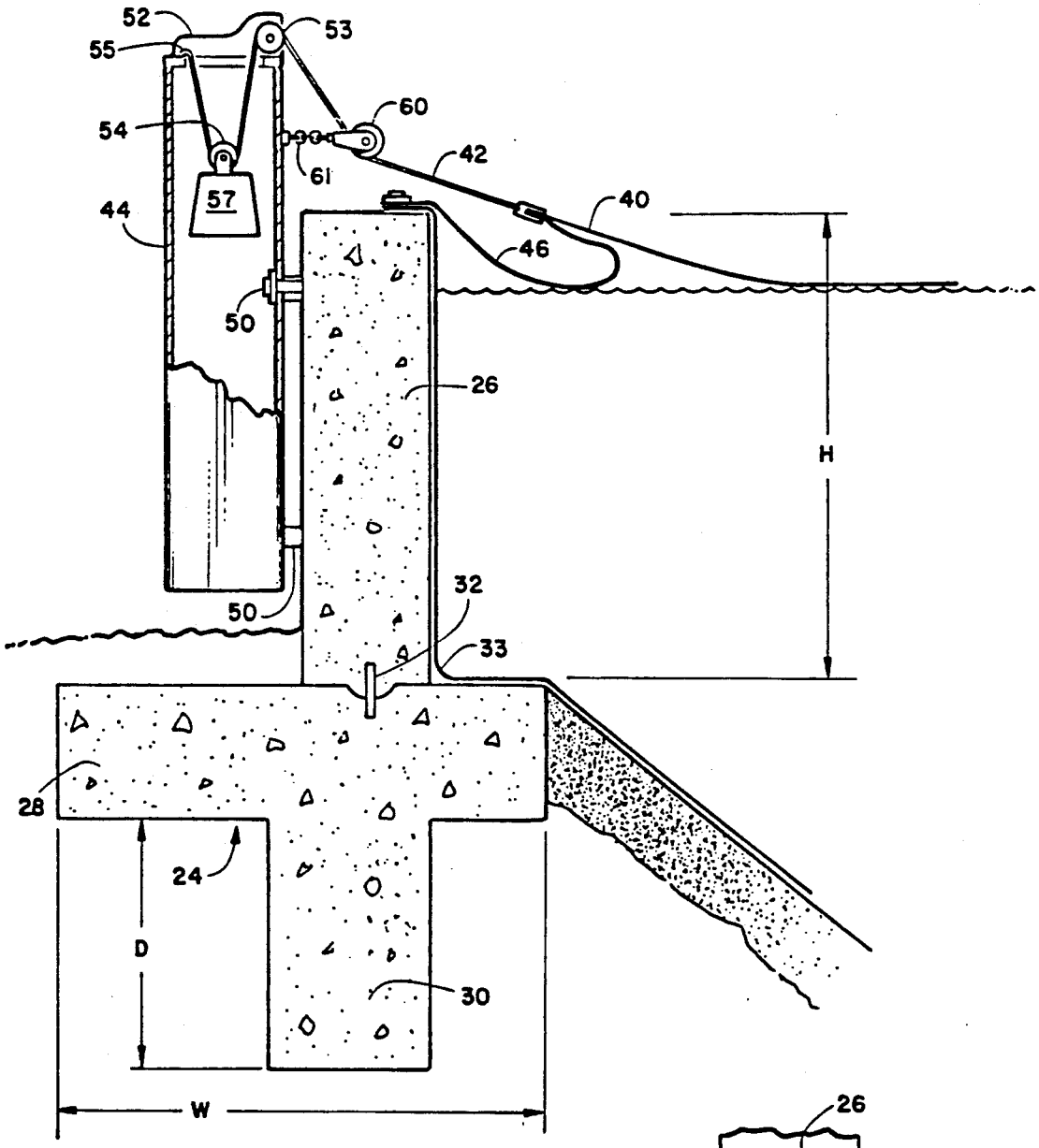
FIG. 4 is a cross sectional elevation view of the combination footing and elevated wall assembly.
Figure 5:
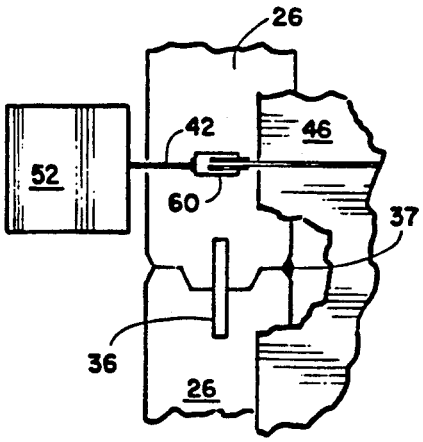
FIG. 5 is a cross sectional view taken along circle 5 of FIG. 3.

The reservoir illustrated in FIGS. 1 and 2 would each have a first liquid reservoir portion 17. With the installation of the inventor's novel EWR systrem, a second liquid reservoir portion 19 would be added thereto which would increase the total volume capacity of the reservoir between 20 and 40%.

The cover assembly 18 has a central portion 40 whose peripheral edge is spaced inwardly from vertical top wall portion 26. A plurality of tension cables 42 have their one end secured to central portion 40 and their other ends secured to mechanical tension towers 44. The manner in which the cables are attached to the central portion 40 of the cover assembly 18 are well known and a specific manner of connecting them is illustrated in U.S. Pat. No. 4,971,217. Likewise, the manner in which the skirt portion 46 of the cover assembly is secured to the central portion 40 is also illustrated in the previously mentioned U.S. patent.

Tension tower 44 is preferrably a hollow metal housing attached to vertical top wall portion 26 by anchoring studs 50. A tower cap 52 has a pulley 53 mounted therein. Tension cable 42 passes over pulley 53 and around pulley 54 with its end being captured by cap screw 55. A 75 to 200 pound weight 57 is attached to the bottom end of pulley 54. A swivel eye block 60 is attached by a chain 61 to tension tower 44. Tension cable 42 passes around the pulley in swivel eye block 60 to keep the skirt portion 46 and central portion 40 plurality of connection points of the cover assembly 18 in close proximity to vertical top wall portion 26.

Figure 7:
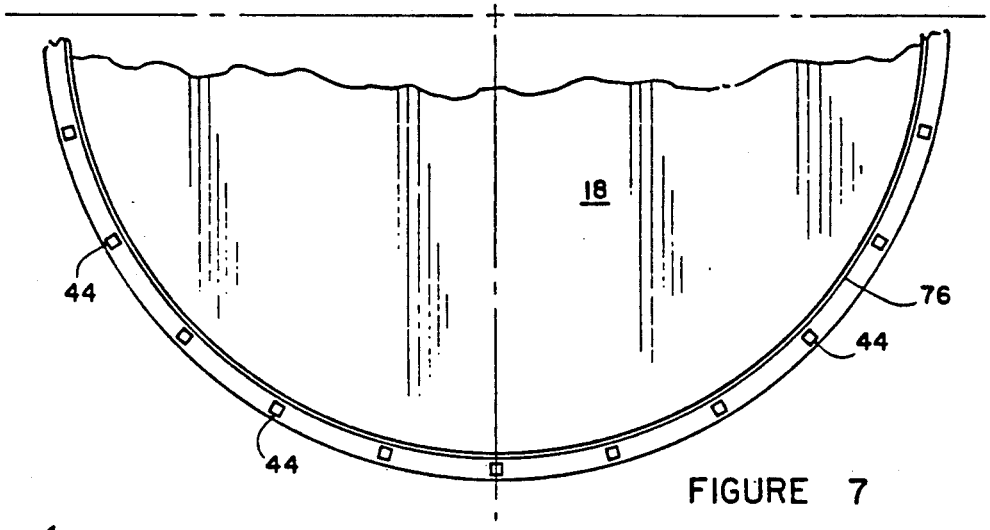
FIG. 7 is a partial top plan view of the embodiment illustrated in FIG. 6.
Figure 6:
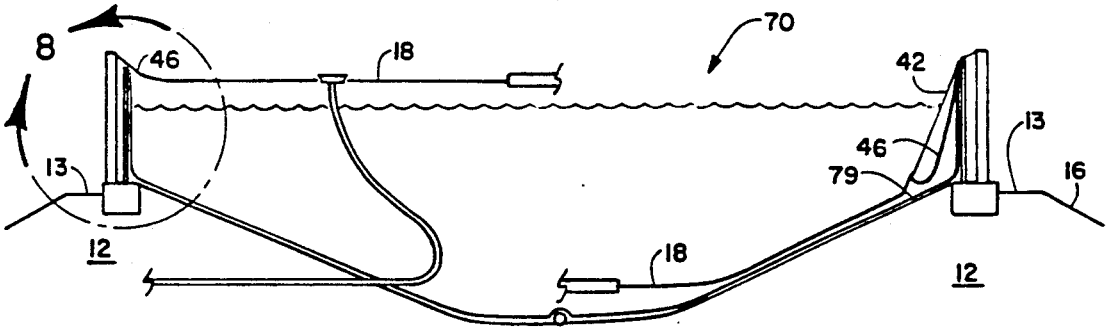
FIG. 6 is a schematic side elevation view of an alternative embodiment of the elevated wall reservoir system.
Figure 8:
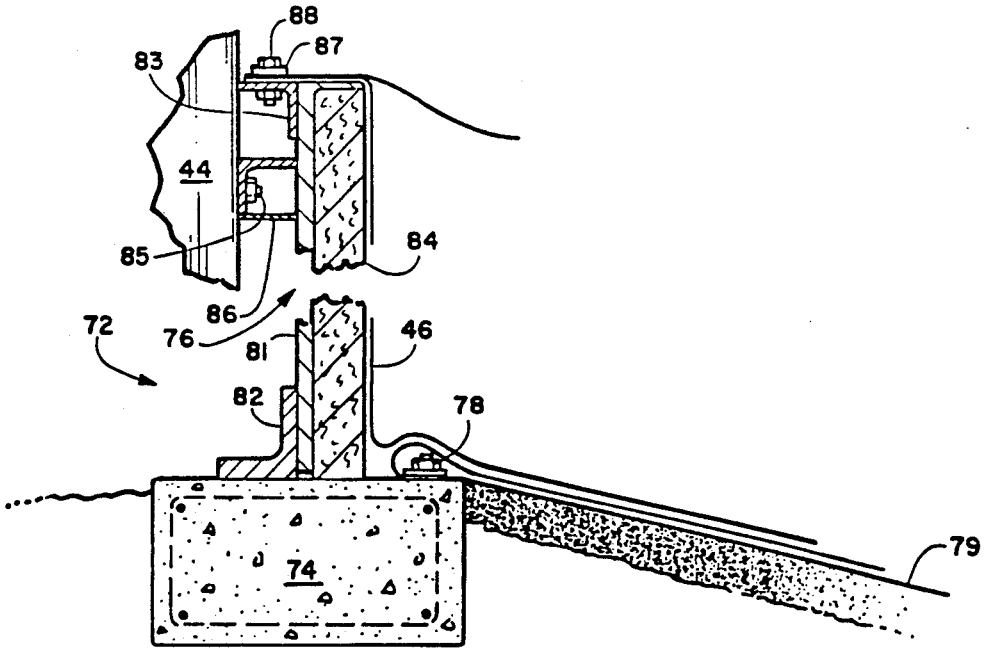
FIG. 8 is an enlarged cross sectional view of the combination footing and elevated wall assembly of the alternative embodiment illustrated in FIGS. 6 and 7.

An alternative embodiment of the EWR system is illustrated in FIGS. 6–8. Half of FIG. 6 shows the reservoir 70 with the water level at its highest point and half of the Figure also at it lowest point. The ERW system has a combination footing and vertical wall assembly 72. This assembly has a footing portion 74 and a vertical top wall portion 76.

Concrete footing 74 would be installed in the horizontal ground surface 13. It would form a closed loop conforming to the configuration of the reservoir. An anchor bolt 78 extending from concrete footing 74 secures the edge of the liner 79.

The vertical wall portion 76 is formed from a plurality of steel wall sections 81 having an angle member 82 welded at its bottom end and an angle member 83 welded to its top end. There are vertical angle members at each end of the steel wall sections and the adjacent steel wall sections are bolted together at these vertical angle members. A layer of insulation 84 is formed on the inner surface of steel wall section 81. It functions to prevent heat transfer from the outer wall section to the water on hot days and functions to prevent the cold from being transferred from the steel wall to the water on cold days. The insulation also provides a barrier between the steel walls and the skirt 46 of the cover assembly 18 and thereby prevents abrasion to the skirt 46 as it travels upwardly and downwardly along vertical top wall portion 76. The tension towers 44 are the same as previously described and are mounted by anchoring bolts 85 that are attached to brackets 86 welded to the outside surface of steel wall section 81. The top end of skirt 46 is secured by cover clamping bar 87 and bolt 88. Tension cables 42 have their top ends passing around pulleys in tension towers 44 in the same manner as was previously described.

What is claimed is:

1. An elevated wall reservoir system comprising:

a closed loop horizontal ground surface having a predetermined configuration, said horizontal ground surface having an inner edge and an outer edge, an inner surface extends downwardly from said inner edge to form a first liquid reservoir portion that is located below said closed loop horizontal ground surface;

a combination footing and elevated wall assembly is installed in said horizontal ground surface and it extends around the entire perimeter of said inner surface to form a closed loop structure;

said combination footing and elevated wall assembly having a concrete footing portion and a concrete vertical wall portion; said footing portion having a cross sectional configuration having a horizontal base member having a predetermined width W, said base member having a top surface, a vertical leg portion extends downwardly from said bottom surface and it has a predetermined height D; a vertical top wall portion has a top surface, a bottom surface, an outer surface and an inner surface, said vertical top wall portion having a predetermined height H; the bottom surface of said vertical top wall being secured to the top surface of said base member;

a plurality of tension towers spaced around the perimeter of said combination concrete footing and elevated wall assembly;

a cover assembly for said elevated wall reservoir system, said cover assembly having a central portion whose peripheral edge is spaced inwardly from said vertical top wall portion; and means connecting the peripheral edge of said cover assembly to said respective tension towers.

2. An elevated wall reservoir system as recited in claim 1 wherein said closed loop horizontal ground surface has a configuration that is four sided.

3. An elevated wall reservoir system as recited in claim 1 wherein said concrete vertical wall portion is formed of a plurality of sections that are oriented lengthwise to each other and means for connecting them together.

4. An elevated wall reservoir system as recited in claim 1 wherein said cover assembly has a peripheral skirt whose one edge is connected to the top end of said concrete vertical wall portion around its inner periphery.

5. An elevated wall reservoir system as recited in claim 1 wherein said tension towers have a tubular configuration.

6. An elevated wall reservoir system comprising:

a closed loop horizontal ground surface having a predetermined configuration, said horizontal ground surface having an inner edge and an outer edge, an inner surface extends downwardly from said inner edge to form a first liquid reservoir portion that is located below said closed loop horizontal ground surface;

a combination footing and elevated wall assembly is installed in said horizontal ground surface and it extends around the entire perimeter of said inner surface to form a closed loop structure;

said combination footing and elevated wall assembly having a concrete footing portion and a vertical steel plate wall portion; said footing portion having a horizontal top surface, said steel plate portion being mounted on said horizontal top surface;

a plurality of tension towers spaced around the perimeter of said combination concrete footing and elevated wall assembly;

a cover assembly for said elevated wall reservoir system, said cover assembly having a central portion whose peripheral edge is spaced inwardly from said steel plate wall portion; and means connecting the peripheral edge of said cover to said respective tension towers.

7. An elevated wall reservoir system as recited in claim 1 wherein said closed loop horizontal ground surface has a configuration that is circular.

8. An elevated wall reservoir system as recited in claim 6 wherein said steel plate wall portion has an outer surface, an inner surface, a top edge and a bottom edge, horizontally oriented top and bottom angle members are welded to the outer surface of said steel plate wall portion adjacent its respective top and bottom edges and said combined structure is free-standing on the top surface of said concrete footing portion.

9. An elevated wall reservoir system as recited in claim 6 wherein said cover assembly has a peripheral skirt whose one edge is connected to the top end of said steel plate wall portion around its inner periphery.

10. An elevated wall reservoir system as recited in claim 6 wherein said tension towers have a tubular configuration.

* * * * *